United States Patent [19]

Höppel

[11] 4,387,687

[45] Jun. 14, 1983

[54] CONTROL APPARATUS FOR A FUEL METERING SYSTEM IN AN INTERNAL COMBUSTION ENGINE

[75] Inventor: Rainer Höppel, Stuttgart, Fed. Rep. of Germany

[73] Assignee: Robert Bosch GmbH, Stuttgart, Fed. Rep. of Germany

[21] Appl. No.: 209,346

[22] Filed: Nov. 21, 1980

[30] Foreign Application Priority Data

Dec. 5, 1979 [DE] Fed. Rep. of Germany ..... 2948867

[51] Int. Cl.[3] ..... F02B 3/02; F02D 5/00

[52] U.S. Cl. ..... 123/493; 123/453

[58] Field of Search ..... 123/453, 493, 491, 179 L, 123/179 G

[56] References Cited

U.S. PATENT DOCUMENTS

| | | | |
|---|---|---|---|
| 3,463,130 | 8/1969 | Reichardt | 123/491 |
| 3,742,920 | 7/1973 | Black | 123/493 |
| 4,159,697 | 7/1979 | Sweet | 123/491 |
| 4,173,953 | 11/1979 | Pocholle | 123/491 |
| 4,193,380 | 3/1980 | Marchak et al. | 123/491 |
| 4,198,932 | 4/1980 | Reddy et al. | 123/491 |
| 4,208,991 | 6/1980 | Reddy | 123/491 |
| 4,266,522 | 5/1981 | Williams et al. | 123/493 |

FOREIGN PATENT DOCUMENTS

| | | | |
|---|---|---|---|
| 1125718 | of 0000 | Fed. Rep. of Germany | 123/493 |

*Primary Examiner*—Raymond A. Nelli

*Attorney, Agent, or Firm*—Edwin E. Greigg

[57] ABSTRACT

A control apparatus is proposed for a fuel metering system of an internal combustion engine having at least one additively functioning warmup enrichment circuit. The apparatus is characterized in that the additive enrichment can be reduced during overrunning. The purpose of this feature is to maintain the cleanest possible exhaust gas even during the warmup phase during overrunning. This is attained, for instance, by means of a logical linkage of an overrunning recognition signal and the output signal of an additively functioning correction circuit for the metering signal.

5 Claims, 1 Drawing Figure

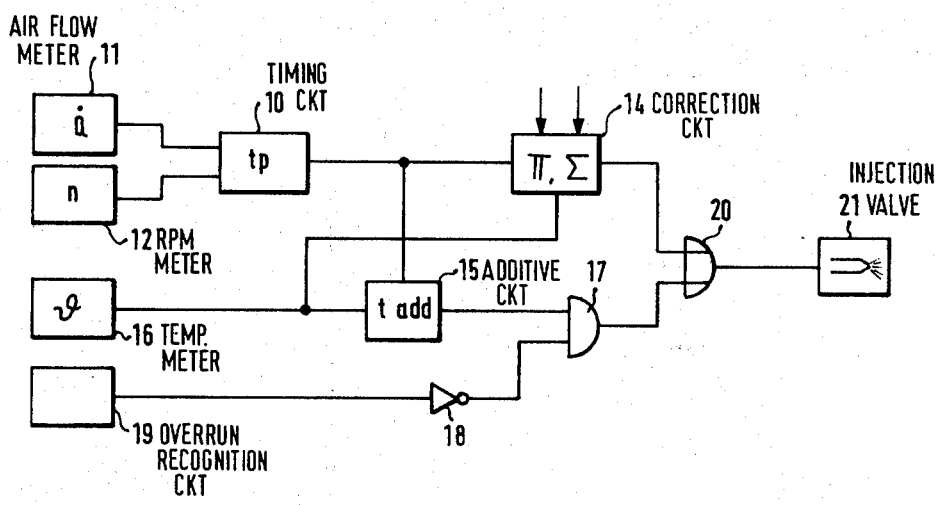
AIR FLOW METER 11
TIMING 10 CKT
14 CORRECTION CKT
INJECTION 21 VALVE
20
12 RPM METER
15 ADDITIVE CKT
17
16 TEMP. METER
19 OVERRUN RECOGNITION CKT
18
tp
t add
n

CONTROL APPARATUS FOR A FUEL METERING SYSTEM IN AN INTERNAL COMBUSTION ENGINE

BACKGROUND OF THE INVENTION

U.S. Pat. No. 3,463,130, W. Reichardt et al., is incorporated by reference.

The invention relates to a control apparatus, such as disclosed from German Pat. No. 1,125,718, for a fuel injection system in an externally ignited internal combustion engine. In the noted German patent, a system is proposed which has two different monostable multivibrators as timing elements; it is stated that the second mutlivibrator "prolongs" the injection time "in accordance with internal or external operating conditions of the internal combustion engine, and in particular in accordance with the coolant temperature or conditions prevailing at engine starting, for instance, by addition of a further period of time or a further quantity of fuel". In so doing, this additive enrichment preferably acts in accordance with temperature in the case of cold starting and engine warmup. Because under some conditions the warmup phase may last for a relatively long period of time, there may briefly be poor exhaust-emission values. In view of present and future exhaust regulations, it is accordingly necessary to control the emission of toxic substances reliably during the warmup phase as well.

OBJECT AND SUMMARY OF THE INVENTION

It is therefore the object of the invention to provide a control apparatus for a fuel metering system for an internal combustion engine with the aid of which low exhaust-emission values are attainable even during warmup.

Signals are applied to a fuel injection valve from rpm and air flow meters via a correcting circuit. The valve also receives signals from a temperature meter and an overrun recognition circuit via an additive circuit. These signals, applied to the valve, are adjusted to regulate fuel to the engine according to engine parameters.

At engine start, pulses from the additive circuit are lengthened to provide more fuel. A signal from the overrun recognition circuit will stop the additive circuit pulses from reaching the valve to operate the engine at a normal mode after engine warm-up.

The exhaust-emission values can be kept within prescribed limits, with only a small sacrifice in driving comfort, by using the control apparatus according to the invention for fuel metering systems.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows one exemplary embodiment of the invention, which is described in detail below.

DESCRIPTION OF THE PREFERRED EMBODIMENT

The exemplary embodiment relates to a fuel injection system, acting as a fuel metering system, in an internal combustion engine having externally supplied ignition. The input variables of air throughput in the intake manifold, rpm, and temperature as well as an overrunning recognition signal are processed in this system.

A timing circuit 10 receives input signals from an air throughput meter 11 and from an rpm meter 12. On the output side, the timing circuit 10 is followed by a generalized correction circuit 14 and by an additive correction circuit 15. Both correction circuits 14 and 15 receive an additional control signal from a temperature meter 16. The correction circuit 14 is capable of receiving not only the temperature signal but also other specialized signals, such as an acceleration signal $\alpha$. The correction circuit 15, which functions purely additively, is followed by an AND gate 17, at the second input of which a signal is applied, via an inverter 18, from an overrunning recognition circuit 19 such as shown in U.S. Pat. No. 3,463,130. Such a device is well known in the art in which a conventional blocking circuit is used to inhibit the application of fuel injection pulses of the electronic circuit to the fuel injection valves, the blocking circuit being interconnected with an engine controller such as a gas pedal and further being usually responsive to engine speed such that when the engine is in overrun condition or when the throttle is closed or almost closed the blocking circuit is activated to impede the fuel injection pulses. An OR gate 20 is connected on its input side with the outputs of the correction circuit 14 and the AND gate 17 and is connected on its output side, via a driver circuit which is not shown, with an injection valve 21.

The mode of operation of the control apparatus shown in the drawing and intended for a fuel metering system is as follows:

The pulse generator or timing circuit 10 generates pulses whose pulse duration is directly proportional to the air throughput in the intake manifold and inversely proportional to the rpm. In the subsequent correction circuit 14, these signals are prolonged in multiplicative fashion; supplementarily, they are also prolonged additively to a limited extent. As a result, the injection quantity is made appropriate for special operating conditions. The warmup enrichment is effected primarily via the correction circuit 15, which functions in purely additive fashion. The output signal of this correction circuit 15 then becomes effective via the AND gate 17 only whenever the condition of overrunning is not present, and thus the output of the inverter 18 is at high potential. In this case, a signal then appears at the output of the OR gate 20 which corresponds in length to the instantaneous maximal enrichment. The injection pulses then correspond in duration to the length of the signals appearing at the output of the OR gate 20.

If overrunning occurs, which is detected either in combination with the actuation of a throttle valve switch or on the basis of the air flow rate, then the AND gate 17 blocks the output signal of the purely additive correction circuit 15, so that only the output signal of the correction circuit 14 finally takes effect at the injection valve 21. For this reason, the warmup enrichment is thus reduced during overrunning, so that the mixture becomes relatively lean. The slight worsening in engine behavior which this causes is generally within acceptable limits.

It has proved to be favorable for the enrichment during warmup to be effected both multiplicatively and additively, the additive component being particularly large. It is only this large additive component which is reduced in the case of overrunning. The small enrichment intended to provide satisfactory driving comfort can then be effected either via the multiplicative component or via a small additive component, which is likewise created in the correction circuit 14.

Although the described example relates to a fuel injection system, the invention must also be understood to be entirely independent of the type of fuel metering with which it may be associated. For instance, it may be used in controlled carburetor systems as well.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a control apparatus for a fuel management system of an internal combustion engine having pulse operated fuel control means, pulse generating means for generating pulses for operating the fuel control means, and first correction circuit means connected to the pulse generating means for lengthening the pulses, during engine warm-up, the improvement comprising:

second correction circuit means connected to the pulse generating means for lengthening the pulses to a greater extent than said first correction circuit means, during engine warm-up;

means for detecting an engine overrunning condition;

and a third circuit means in response thereto for applying only the pulses from the first correction circuit means to the fuel control means during the engine overrunning condition.

2. In the control apparatus as defined in claim 1, wherein the pulses generated by the first correction circuit means are lengthened both multiplicatively and additively, wherein the pulses generated by the second correction circuit means are lengthened additively, and wherein the additive lengthening produced by the first correction circuit means is blocked by said third circuit means except during the engine overrunning condition.

3. In the control apparatus as defined in claim 1, wherein the means for detecting detects an engine overrunning condition directly from the engine throttle valve.

4. In the control apparatus as defined in claim 1, wherein the means for detecting detects an engine overrunning condition from the air throughput in the engine intake manifold.

5. In the control apparatus as defined in claim 1, wherein the means for detecting detects an engine overrunning condition directly from the egine throttle valve and the air throughput in the engine intake manifold.

* * * * *